US006182751B1

(12) United States Patent
Koshkin et al.

(10) Patent No.: US 6,182,751 B1
(45) Date of Patent: Feb. 6, 2001

(54) BOREHOLE SUCKER-ROD PUMPING PLANT FOR PUMPING OUT GAS LIQUID MIXTURES

(76) Inventors: Konstantin Ivanovich Koshkin, ulitsa Molodogvardeiskaya, 225, kv. 124, Samara; Ivan Yakovlevich Kljushin, ulitsa Mendeleeva, 6-b, kv. 6, Nizhnevartovsk, both of (RU)

( * ) Notice: Under 35 U.S.C. 154(b), the term of this patent shall be extended for 0 days.

(21) Appl. No.: 08/899,482

(22) Filed: Jul. 24, 1997

(30) Foreign Application Priority Data

Dec. 25, 1996 (RU) ..... 96123935
Dec. 25, 1996 (RU) ..... 96123936

(51) Int. Cl.[7] ..... E21B 43/00
(52) U.S. Cl. ..... 166/68.5; 166/105.5
(58) Field of Search ..... 166/68, 68.5, 105, 166/105.1, 105.3, 105.5, 105.6

(56) References Cited

U.S. PATENT DOCUMENTS 1,578,720 * 3/1926 Derby ..... 166/105.5
2,910,002 * 10/1959 Morgan ..... 166/105.5
3,483,827 * 12/1969 Hooper ..... 166/105.5
3,594,103 * 7/1971 Hillis ..... 417/435

FOREIGN PATENT DOCUMENTS

866133 * 9/1981 (SU) ..... 166/105.5

* cited by examiner

*Primary Examiner*—William Neuder

(57) ABSTRACT

A borehole sucker-rod pumping plant for pumping out gas liquid mixtures comprising a driving rocker to which a string of sucker rods is connected that is secured to a plunger of a deep well pump having a first and suction valve in the lower part of a cylinder, a second suction valve in the cylinder wall at a distance from the first valve, and a pressure valve mounted in the plunger. The plant further comprises a receiving chamber separating the gas liquid mixture into a gas phase and a liquid phase and ensuring that the gas phase gets compressed. The chamber is arranged to be disposed upstream of the cylinder and has in one of the embodiments thereof an outlet valve mounted in its upper part upstream of the first suction valve. In another embodiment, the receiving chamber has an outlet pipeline disposed in the upper part thereof and communicated with the second suction valve.

5 Claims, 1 Drawing Sheet

BOREHOLE SUCKER-ROD PUMPING PLANT FOR PUMPING OUT GAS LIQUID MIXTURES

FIELD OF THE INVENTION

The present invention relates to the field of oil productions and, more specifically, concerns a borehole sucker-rod pumping plant for pumping out gas liquid mixtures.

This technical solution can be successfully used for increasing the operating flow rates of oil wells, predominantly oil wells with complicated conditions and, in particular, where there are large quantities of casing head gas, viscous and paraffinacous crudes, foreign particles in oil, and permafrost within the well section.

DESCRIPTION OF THE PRIOR ART

Borehole sucker-rod pumping plants are widely used in world practice for pumping out gas liquid mixtures. Usually such a plant comprises a driving rocker having an output member executing reciprocational movement in a vertical direction; a string of sucker rods connected to the output member of the driving rocker; a string suspension arranged in a well, said string of sucker rods being positioned in this string suspension so that it can reciprocate therein to follow the movement of the output member of the rocker; and a deep well pump secured to the lower end of the string suspension. The deep well pump is the most important component of the borehole pumping plant in that the efficiency of pumping out oil from a well is determined mostly by the technical characteristics of the deep well pump.

Thus, in particular, a borehole sucker-rod pumping plant is known in prior art to have a deep well pump (described in SU, A, 545769) which comprises a cylinder, a plunger installed in this cylinder so as to be capable of reciprocational movement and connected to the lower end of a string of rods, a pressure valve built in the plunger, and a suction valve mounted higher than the lower end face of the cylinder by the size of the dead zone.

The borehole sucker-rod pumping plant with such a deep well pump is characterized by a comparatively high efficiency factor, due to eliminating the influence of the dead zone of the cylinder on the operation of the pump. However, this plant shows low efficiency when pumping out oil having a high content of free gas, in so far as a gas content higher than critical value having its definite value in each particular case leads to a failure of the suction valve. In order to avoid this, the pumping plant is, as a rule, further equipped with a gas separator mounted in front of the cylinder. However, this leads to complicating the plant and, correspondingly, to an increase of costs.

In addition to this, a borehole pumping unit is known in prior art to have a deep well pump (see SU, A, 1323743) which, in contrast to what is described above, further comprises one suction valve more, installed at the lower end of the cylinder.

This plant allows the pumping out of a gas liquid mixture having a high content of gas; however, in order to ensure an efficient operation of the plant, the gas liquid mixture must not contain foreign particles and must be watered and contain at least 20% water, and the water stratum must underlay the oil-bearing stratum.

When pumping out gas liquid mixtures from waterless or slightly watered (less that 20% water) wells, free gas enters the lower part of the cylinder together with oil and disables the deep well sucker-rod pump.

In addition to this, in operation of the known pumping plants, the pumping out of the liquid gas mixture is substantially due to the power consumed by the driving rocker so that, in this case, the energy of casing head gas distributed throughout the entire volume of gas liquid mixture is practically not used.

SUMMARY OF THE INVENTION

It is one object of the invention to reduce consumption of power during production of oil by using as much as possible the energy of casing head gas when lifting oil from the well.

Another object of the invention is to ensure the operation of a borehole sucker-rod pumping plant on wells with complicated conditions, i.e., where there are high concentrations of casing head gas or viscous and paraffinaceous crudes, or where there is a permafrost zone within the well section.

A third object is to ensure a reliable and efficient operation of a borehole sucker-rod pumping plant when pumping out foamed oil having foreign particles from waterless oil wells.

These and other objects are accomplished in accordance with one aspect of the invention by a borehole sucker-rod pumping plant for pumping out gas liquid mixtures, comprising a driving rocker; a string of sucker rods having one end attached to an output member of the driving rocker and the other end secured to a plunger of a deep well pump having a main suction valve mounted in the lower part of a cylinder, a supplementary suction valve mounted in the cylinder wall at a distance from the main valve in the direction of the cylinder axis, and a pressure valve mounted in the plunger; a receiving chamber arranged to be disposed upstream of the cylinder and equipped with an outlet valve mounted in its upper part upstream with respect to the main suction valve; two substantially vertical channels arranged in the chamber cavity, the first channel having the upper end thereof in communication with an inlet side of the main suction valve of the deep well pump and having the lower end thereof open into the chamber cavity, the second channel having the lower end thereof in communication with an inlet opening of the chamber having the upper end thereof open into the chamber space at a level downstream with respect to the open end of the first channel.

Preferably, in order to reduce the overall dimensions of the plant, the supplementary suction valve and the outlet valve are to be made in the form of safety ball valves and arranged coaxially one under the other.

In accordance with a second aspect of the invention, the objects are accomplished by a borehole sucker-rod pumping plant for pumping out gas liquid mixtures, comprising a driving rocker; a string of sucker rods having one end attached to an output member of the driving rocker and the other end secured to a plunger of a deep well pump having a main suction valve mounted in the lower part of a cylinder, a supplementary suction valve mounted in the cylinder wall at a distance from the main valve in the direction of the cylinder axis, and a pressure valve mounted in the plunger; a receiving chamber arranged to be disposed upstream of the cylinder and equipped with an outlet pipeline disposed on the upper end thereof and in communication with an inlet side of the supplementary suction valve; two substantially vertical channels arranged in the chamber cavity, the first channel having the upper end thereof in communication with an inlet side of the main suction valve of the deep well pump and having the lower end thereof open into the chamber cavity, the second channel having the lower end thereof in communication with an inlet opening of the chamber having the upper end thereof open into the chamber space at a level downstream with respect to the open end of the first channel.

It is desirable, in order to minimize the overall dimensions of the plant, to have the outlet pipeline disposed coaxially with the supplementary suction valve.

Preferably, in order to ensure extraction of foreign particles, an accumulator of solid foreign particles is installed in the lower part of the receiving chamber.

A borehole sucker-rod pumping plant made in accordance with the present invention is characterized by high efficiency, allowing reduction of the consumption of power during extraction of oil due to the use of the energy of casing head gas and also due to preparing preliminarily the fluid thus extracted by separating liquid from gas and foreign particles, compressing the gas to a predetermined pressure, and introducing separately the liquid and the gas into the cylinder of the pump so that the liquid is fed into the lower part and the gas into the upper part of the cylinder.

BRIEF DESCRIPTION OF THE DRAWINGS

Hereinafter, the invention is further explained by describing specific alternative embodiments thereof with reference to the accompanying drawings, in which.

DETAILED DESCRIPTION OF THE INVENTION

Figure 1:
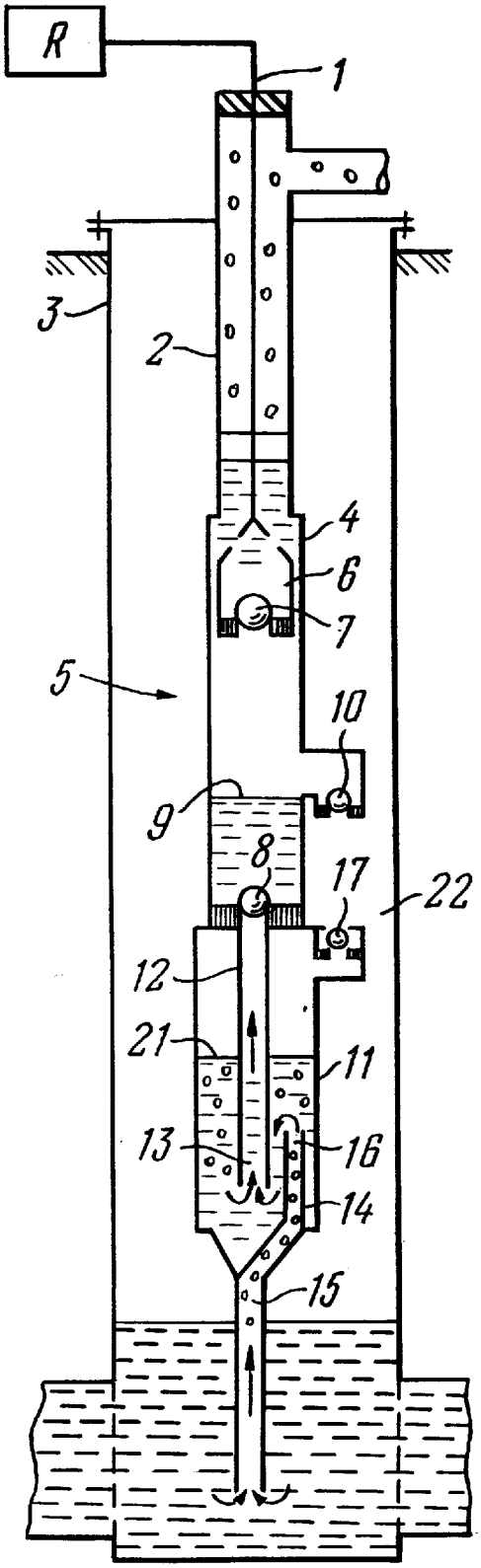
FIG. 1 illustrates schematically a borehole sucker-rod pumping plant for pumping out gas liquid mixtures, according to the invention, in an alternative embodiment thereof for a well where pressure is not high at the depth at which the pump is installed.

An embodiment of the borehole sucker-rod pumping plant as presented in FIG. 1 comprises a driving rocker (arbitrarily not shown in the drawings) located on the surface, an output member of which is connected to a string of sucker rods 1 which is installed in a string suspension 2 arranged in an oil well 3. A cylinder 4 of a deep well sucker-rod pump 5 is secured by its upper end to the lower end of the string suspension 2. A plunger 6 secured to the end of the string of sucker rods 1 is installed in the cavity of the cylinder 4 so as to be capable of reciprocational movement. A pressure valve 7 mounted coaxially with cylinder 4 is built in the plunger 6. At the lower end of the cylinder 4, a suction valve 8 is mounted coaxially with cylinder 4; whereas, in the wall of cylinder 4 at a level 9 spaced at a predetermined distance from the valve 8, a second suction valve 10 is mounted eccentrically with respect to cylinder 4. In addition to this, the plant comprises a receiving chamber 11 arranged upstream of the cylinder 4 coaxially with it and having its upper end connected to the lower end of the cylinder 4. In the receiving chamber 11, there is provided a central channel 12 arranged coaxially with the suction valve 8 and having its upper end in communication with an inlet side of the valve 8, wherein the lower end 13 of the channel 12 is open into the space of the chamber 11 near its lower end. In the chamber 11, there is also an inlet channel 14 arranged substantially vertically with an offset towards the periphery of the chamber 11, and wherein the lower end of this channel is in communication with an inlet 15 of the chamber 11 at its lower end, while the upper end 16 of the channel 14 is open into the space of the receiving chamber 11 at a level downstream with respect to the level at which the lower end 13 of the central channel 12 is arranged. An outlet valve 17 is arranged in the upper end of the side wall of the chamber 11. This valve 17 is located upstream with respect to the suction valve 8 and coaxially with the eccentrically disposed suction valve 10. Ball safety valves can be used as the valves 10 and 17.

Figure 2:
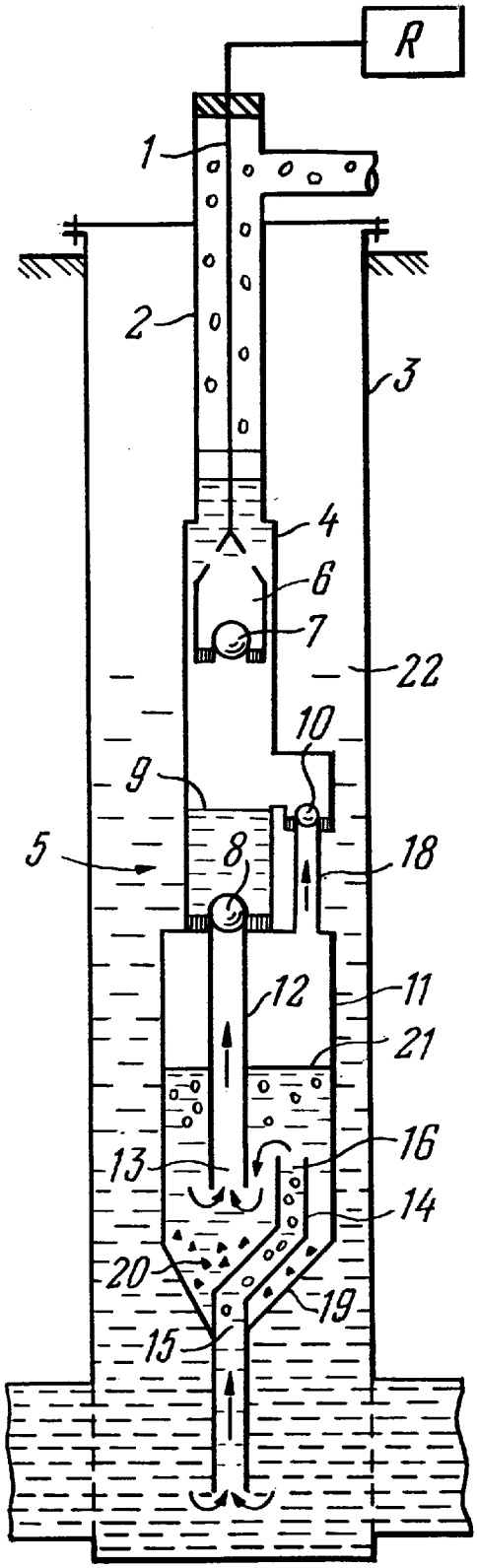
FIG. 2 is the same as in FIG. 1, but in an alternative embodiment for deep wells where the stratum pressure is high and there is a gas cap.

An embodiment of the borehole sucker-rod pumping plant illustrated in FIG. 2 is different from the embodiment presented in FIG. 1 in that instead of having the outlet valve, FIG. 2 has an outlet pipeline 18 that is installed withing the upper part of the receiving chamber 11, said pipeline having its other end in communication with an inlet side of the suction valve 10 and being designed for releasing the gas phase from the upper part of the chamber 11.

In addition to this, the latter embodiment of the plant is equipped with an accumulator 19 disposed in the lower part of the receiving chamber 11 and designed for collecting solid particles 20. All the other components in FIG. 2 perform the same functions as the corresponding components in FIG. 1 so that, in this connection, the same reference numerals are retained for them that are used with respect to FIG. 1.

The operation of the borehole sucker-rod pumping plant for pumping out gas liquid mixtures is carried out as follows.

The alternative embodiment of the borehole sucker-rod pumping plant illustrated in FIG. 1 is designed for pumping out a gas liquid mixture having a high content of the gas phase for wells in which the pressure is not high at the depth where the pump is installed in the well. The gas liquid mixture flows from the well through the peripheral channel 14 to the receiving chamber 11. While being issued from the open end of the channel 14, the gas liquid mixture is separated into the gas phase, which accumulates within the upper part of the chamber 11, and the liquid phase, which flows down into the lower part of this chamber. The interface 21 between the gas and the liquid phases in the receiving chamber 11 defines the degree to which the portion of the gas phase gets compressed in the chamber 11.

The receiving chamber 11 disposed upstream of the inlet of liquid into the cylinder ensures separation of the liquid and the gas and a separate supply, first, of the liquid, and then, of the gas into the cavity of the cylinder 4. The outlet 17 of the receiving chamber 11 is arranged to be disposed lower than the valve 8 and coaxially with the eccentrically located suction valve 10, thereby ensuring the supply of gas into the cylinder 11 in predetermined volumes, with the receiving chamber 11 having minimum dimensions.

The suction valve 8 ensures the reception of liquid without gas in the cavity of the cylinder 4 owing to the fact that this valve is disposed within the lower part and on the axis of cylinder 4.

In order to ensure the reception of gas without liquid in the cavity of the cylinder, the suction valve 10 is arranged to be disposed higher than the suction valve 8 and eccentrically with respect to the axis of the cylinder 4.

Let us assume that the plunger 6 is located in its lowermost position, i.e., below the plunger 6 is located the dead zone of cylinder 4, where there is oil without gas, the pressure in this zone of the cylinder 4 being equal to the pressure at the pump outlet. As the plunger 6 moves upwards, the pressure valve 7 closes, and the pressure in the cylinder 4 of the pump will instantaneously fall so as to be equal to the pressure on the inlet side of the main suction valve 8. As this takes place, the main suction valve 8 will open, and oil will begin to flow from the receiving chamber 11 into the cylinder 4 of the pump 5. The supply of oil from the receiving chamber 11 to the cylinder 4 of the pump is carried out through the central channel 12, whereas the gas flows over through the outlet valve 17 from the upper part of the receiving chamber 11 into the hole clearance 22 of the well. The process of filling the cylinder 4 with oil will continue until the lower end face of the plunger 6 lifts to the level 9 where the suction valve 10 is located. At this moment, the suction valve 10 will open, and gas will begin to flow into the cylinder of the pump from the hole clearance 22 of the well. As the gas enters the cylinder 4, the pressure will increase in the latter by a defined value, and the main suction valve 8 will close. The gas will continue to flow into the cylinder 4 until the moment the plunger 6 reaches its uppermost position. With plunger 6 being in its uppermost position, the upper part (above the level 9) of the cylinder 4 will be filled up with oil. The boundary line (level 9) is the place where the gas enters the pump cylinder.

The quantity of oil which fills up the lower part of the cylinder is equal to the volume of oil which has come into the receiving chamber 11 from the well during one cycle of pump operation. The volume of gas in the cylinder corresponds to that quantity of gas which comes from the receiving chamber 11 into the hole clearance 22 of the well during one operation cycle of the borehole sucker-rod pumping plant. The compliance between the oil and gas bleed-off from and inflow into the receiving chamber 11 is attained, first, by adjusting the distance from the suction valve 8 to the plunger 6 when it is in its lowermost position and, second, by maintaining a predetermined pressure within the upper part of the receiving chamber 11. The magnitude of this parameter can be adjusted by varying the position of the liquid level 21 in the receiving chamber 11.

As the plunger moves downward, the suction valve 10 closes, and pressure in the cylinder 4 begins to rise. At the moment when the pressure above and below the plunger 6 becomes equal, the pressure valve opens, and gas begins to flow from the cylinder 4 into the cavity of the pipes of the string suspension 2. The gas will continue to come into the lifting pipes until the plunger 6 reaches the level 9 of the liquid-to-gas interface in the cylinder 4. During the movement of the plunger 6 further downward, oil will flow into the cavity of the pipes of the string suspension. This process will continue until the moment when the plunger 6 reaches its lowermost position.

As the plunger 6 moves upward, the operation cycle of this plant is repeated.

In the process of operation of the plant, according to the invention, oil portions enter the lifting pipes of the string suspension 2 so as to be separated from each other by portions of the gas phase which gets compressed and, hence, heated up in the receiving chamber 11. Owing to this, a reduction in the density of the column of the medium being transported in the lifting pipes and, hence, the consumption of power as required for transportation gets reduced.

In addition to this, as the gas lifts up, it expands, thus imparting additional energy used for transportation, and allowing the additional reduction of the consumption of power. The presence of gas in the hole clearance 22 of the well contributes to lower heat losses, and this is a particularly important advantage if there is a permafrost zone within the well section or if viscous and paraffinaceous crudes are being pumped.

The plant shown in FIG. 2, in contrast to the plant described herein above is designed predominantly for pumping out oil from wells where the oil-bearing stratum occurs at a large depth and is under high pressure and if there is a gas cap above it. In this case, the liquid gas mixture is taken in below the level of the gas cap. In order to avoid high well-head pressures and probable gas leaks, the bore clearance 22 in this case is to be filled up with liquid.

This plant operates substantially similarly to what is described herein above with respect to the alternative embodiment of the plant as illustrated in FIG. 1, the difference being that here the gas phase compressed in the upper part of the receiving chamber 11 is delivered to the inlet side of the suction valve 10 through the outlet pipeline 18 without entering the hole clearance 22. In addition to this, the oil that comes into the lower part of the cylinder 4 through the central channel 12 is cleaned of solid foreign particles 20 which, when the flow of gas liquid mixture turns around at the outlet end 16 of the channel 14 through 180°, fall out, due to gravitational forces, into the accumulator 19 in the lower portion of the receiving chamber 11 and settle down at the bottom of the accumulator 19.

We claim:

1. A borehole sucker-rod pumping plant for pumping out gas liquid mixtures, comprising:

a driving rocker having an output member executing reciprocational movement in a vertical direction;

a string of sucker rods having one end thereof connected to said output member and having a second end;

a string suspension arranged in a well and in which said string of sucker rods is installed;

a cylinder having an upper end connected to said string suspension, and a lower end;

a plunger installed in said cylinder so as to be capable of reciprocational movement and connected to said lower end of said string of sucker rods;

a pressure valve mounted in said plunger;

a first suction valve mounted on said lower end of said cylinder and having an inlet side and an outlet side;

a second suction valve arranged to be disposed in a wall of said cylinder at a level upstream and at a distance from said lower end of said cylinder and having an inlet side and an outlet side;

a receiving chamber having an upper end and a lower end and arranged to be disposed coaxially upstream of said cylinder, said upper end of said receiving chamber being connected with said lower end of said cylinder and having an inlet for said gas liquid mixture at said lower end thereof;

a central channel arranged in said chamber coaxially with said first suction valve, having a first end and a second end, said central channel the first end thereof in communication with said inlet side of said second suction valve, wherein the second end of said central channel is open into an interior space of said receiving chamber at a predetermined level;

an inlet channel arranged in said receiving chamber and oriented substantially vertically, said inlet channel having a lower end and an upper end, said inlet channel having the lower end thereof in communication with said inlet of said chamber, wherein the upper end of said inlet channel is open into the interior space of said receiving chamber at a level located above said second end of the central channel so that, owing to this, there takes place the separation of said gas liquid mixture into a liquid phase which flows over from said upper end of said inlet channel into said second end of said central channel, and a gas phase which is accumulated in said upper end of the chamber;

an outlet valve in the wall of said receiving chamber at said upper end thereof; and said outlet valve which has an actuation pressure thereof selected so as to ensure that said gas phase gets compressed in said upper end of said receiving chamber to take up a volume not exceeding the volume of that part of said cylinder which extends from said level where said second suction valve is disposed and up to said plunger when the latter is in its uppermost position.

2. The plant according to claim 1, wherein said second suction valve and said outlet valve are essentially ball safety valves and are arranged coaxially one under the other.

3. A borehole sucker-rod pumping plant for pumping out gas liquid mixtures, comprising:

a driving rocker having an output member executing reciprocational movement in a vertical direction;

a string of sucker rods having one end thereof connected to said output member and having a second end;

a string suspension arranged in a well and in which said string of sucker rods is installed;

a cylinder having an upper end connected to said string suspension, and a lower end;

a plunger installed in said cylinder so as to be capable of reciprocational movement and connected to said lower end of said string of sucker rods;

a pressure valve mounted in said plunger;

a first suction valve mounted on said lower end of said cylinder and having an inlet side and an outlet side;

a second suction valve arranged to be disposed in a wall of said cylinder at a level upstream and at a distance from said lower end of said cylinder and having an inlet side and an outlet side;

a receiving chamber having an upper end and a lower end and arranged to be disposed coaxially upstream of said cylinder, said upper end of said receiving chamber being connected with said lower end said cylinder and having an inlet for said gas liquid mixture at said lower end thereof;

a central channel arranged in said chamber coaxially with said first suction valve, and having a first end and a second end, said central channel the first end thereof in communication with said inlet side of said second suction valve, wherein the second end of said central channel is open into an interior space of said receiving chamber at a predetermined level;

an inlet channel arranged in said receiving chamber and oriented substantially vertically, said inlet channel having a lower end and an upper end, said inlet channel having the lower end thereof in communication with said inlet of said chamber, wherein the upper end of said inlet channel is open into a space of said chamber at a level located above said second end of the central channel so that, owing to this, there takes place the separation of said gas liquid mixture into a liquid phase which flows over from said upper end of said inlet channel into said second end of said central channel, and a gas phase which is accumulated in said upper end of the chamber; and an outlet pipeline in said receiving chamber, said outlet pipeline being adjacent the upper end of said receiving chamber and intended for discharging said gas phase, and said outlet pipeline being communicated with said inlet side of said second suction valve.

4. The plant according to claim 3, wherein said outlet pipeline is disposed coaxially with said second suction valve.

5. The plant according to claim 4, further comprising an accumulator of solid foreign particles disposed at the lower end of said receiving chamber.

* * * * *